US006620015B2

(12) United States Patent
Thai

(10) Patent No.: US 6,620,015 B2
(45) Date of Patent: Sep. 16, 2003

(54) BUBBLE GENERATING DEVICE

(75) Inventor: Douglas Thai, Walnut, CA (US)

(73) Assignee: Arko Development Limited (HK)

( * ) Notice: Subject to any disclaimer, the term of this patent is extended or adjusted under 35 U.S.C. 154(b) by 0 days.

(21) Appl. No.: 09/978,135

(22) Filed: Oct. 15, 2001

(65) Prior Publication Data

US 2003/0073374 A1 Apr. 17, 2003

(51) Int. Cl.[7] ..... A63H 33/28
(52) U.S. Cl. ..... 446/15; 446/21
(58) Field of Search ..... 446/15, 16, 17, 446/18, 19, 20, 21; 403/396, 388, 389

(56) References Cited

U.S. PATENT DOCUMENTS 156,923 A * 11/1874 Harwood ..... 446/20
673,488 A * 5/1901 Waterman et al. ..... 446/19
3,064,387 A * 11/1962 Campbell ..... 446/21
3,952,447 A * 4/1976 Hackell ..... 446/19
5,177,927 A * 1/1993 Goya et al. ..... 403/277

* cited by examiner

*Primary Examiner*—Derris H. Banks
*Assistant Examiner*—Bena B. Miller
(74) *Attorney, Agent, or Firm*—Raymond Sun

(57) ABSTRACT

A bubble producing device has at least one loop, with each loop having a cylindrical wall having an interior channel, a top edge and a bottom edge. A flared edge extends at an angle with respect to the cylindrical wall from a portion of the bottom edge. A connector is attached to the cylindrical wall of each loop at a location that is offset from the top edge of each loop.

12 Claims, 3 Drawing Sheets

BUBBLE GENERATING DEVICE

BACKGROUND OF THE INVENTION

1. Field of the Invention

The present invention relates to bubble-producing devices, and in particular, to a bubble generating device that produces higher-quality bubbles.

2. Description of the Prior Art

Bubble producing toys are very popular among children who enjoy producing bubbles of different shapes and sizes. Many bubble producing toys have previously been provided. Perhaps the simplest example has a stick with a circular opening or loop at one end, resembling a wand. A film is produced when the loop is dipped into a bubble solution or bubble producing fluid (such as soap) and then removed therefrom.

Other attempts have been made to provide bubble producing toys that offer more variety and amusement. For example, bubble producing devices having a plurality of adjacent loops are provided to produce multiple bubbles. These bubble producing devices can be dipped into bubble solution and exposed to a wind source (e.g., a user blowing air at the loops, or in front of a mechanized fan or other source of air) to generate a plurality of bubbles.

Unfortunately, all of these previously known or available bubble producing devices suffer from the drawback that they do not always consistently produce good and distinct bubbles. For example, some of the bubbles stick or attach to other bubbles. This problem is typically experienced by devices that attempt to produce more than one bubble, and where the bubble solution may cover or coat adjacent surfaces of the loops and shapes that define these multiple bubbles.

Another drawback associated with these previously known or available bubble producing devices is that they often do not effectively produce a large number of bubbles.

Thus, there remains a need to provide devices that can more effectively produce a larger number of high quality bubbles.

SUMMARY OF THE DISCLOSURE

It is an object of the present invention to provide a bubble producing device that produces a large number of bubbles.

It is another object of the present invention to provide a bubble producing device that produces bubbles of improved quality.

It is yet another object of the present invention to provide a bubble producing device that produces separate and distinct bubbles that are not attached to other bubbles.

The objectives of the present invention are accomplished by providing a bubble producing device that has at least one loop, with each loop having a cylindrical wall having an interior channel, a top edge and a bottom edge. In one embodiment, a flared edge extends at an angle with respect to the cylindrical wall from a portion of the bottom edge. In another embodiment, a connector is attached to the cylindrical wall of each loop at a location that is offset from the top edge of each loop.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
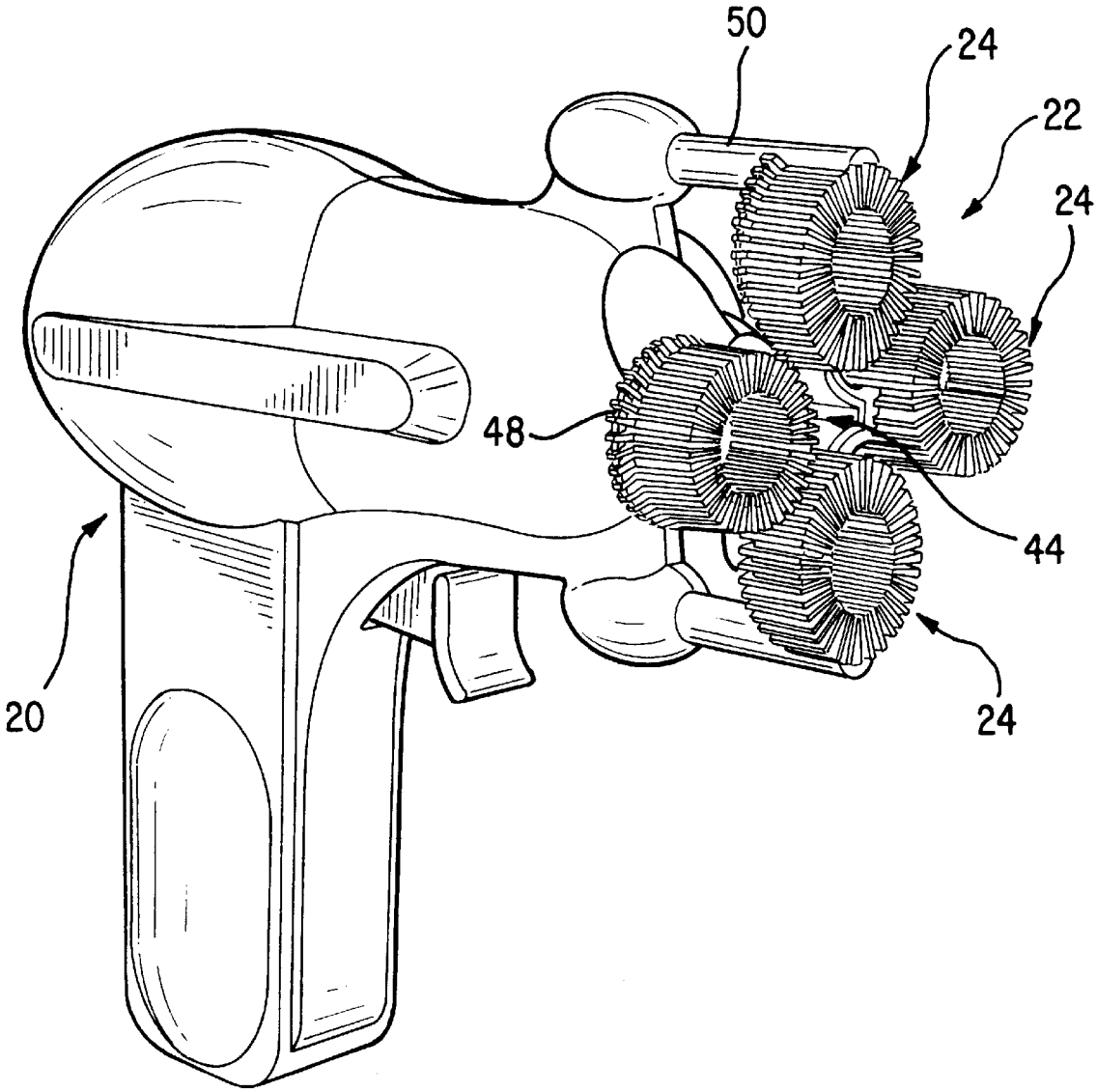
FIG. 1 is a perspective view of a bubble gun assembly that incorporates a bubble producing device according to one embodiment of the present invention.
Figure 2:
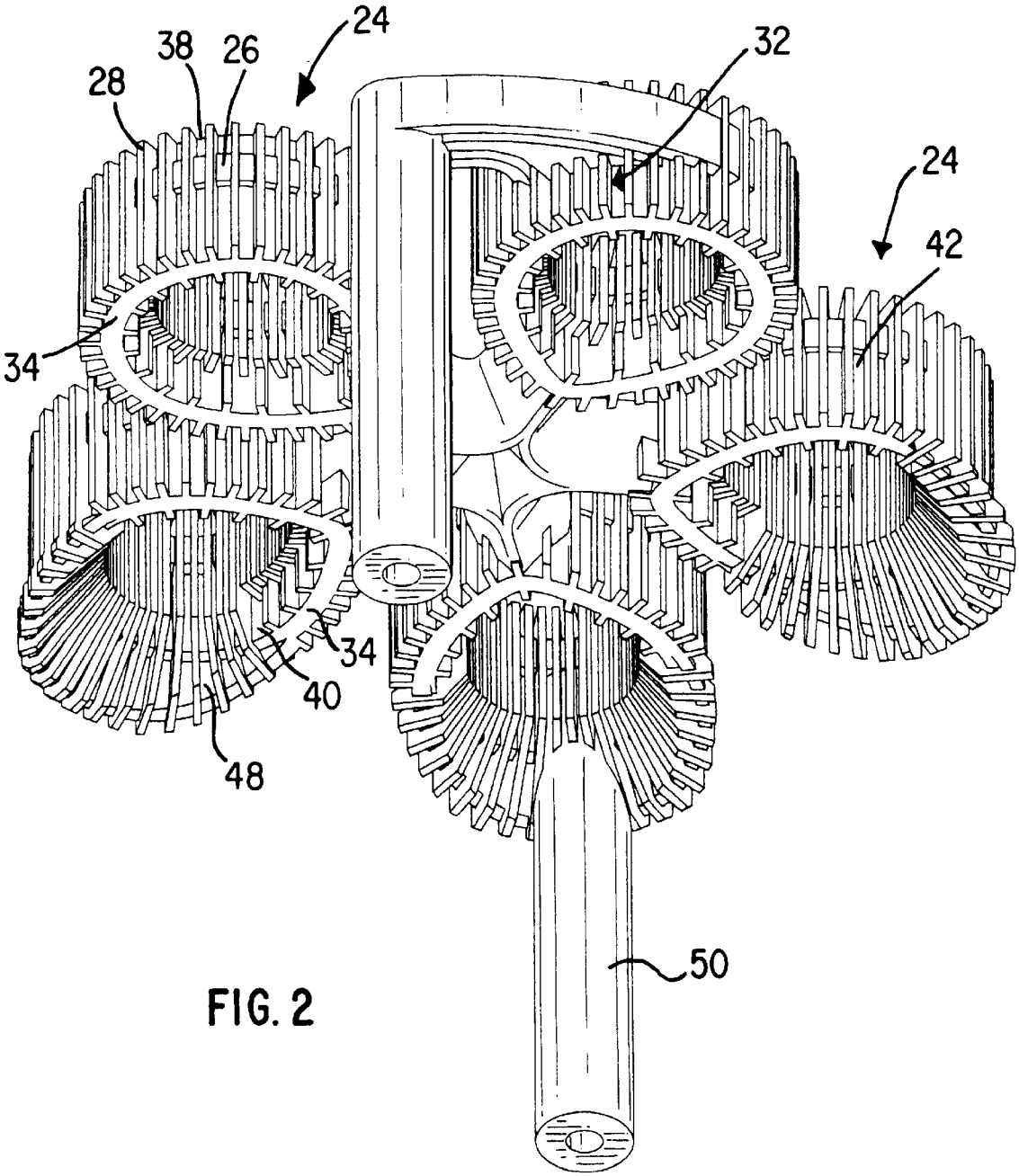
FIG. 2 is a perspective view of the bubble producing device of FIG. 1.
Figure 3:
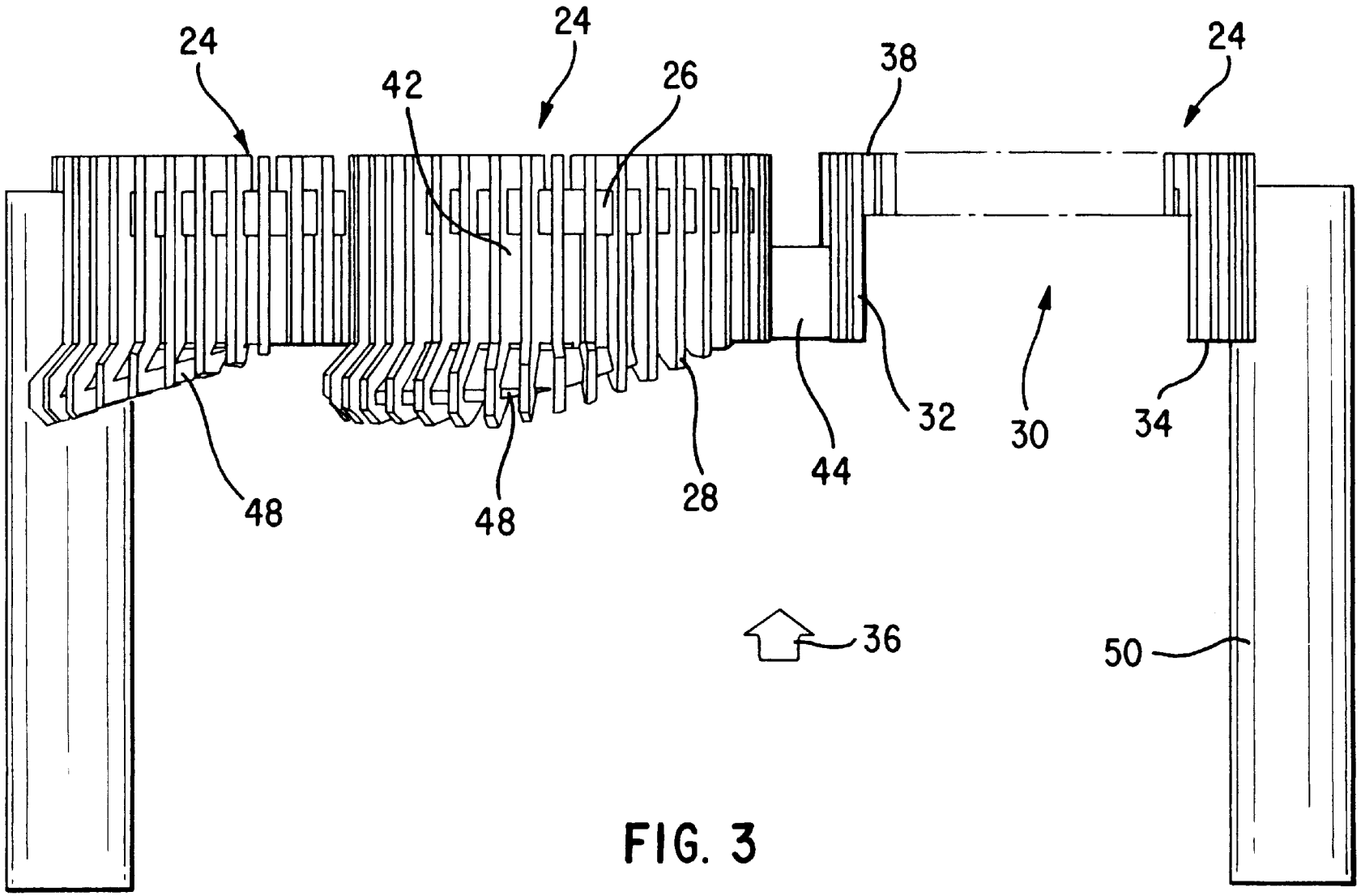
FIG. 3 is a partial side plan view and a partial cross-sectional view of the bubble producing device of FIG. 2.

FIGS. 1–3 illustrate a bubble gun assembly 20 that incorporates a bubble producing device 22 according to one embodiment of the present invention. The bubble producing device 22 has a plurality of cylindrical loops 24, and each loop 24 can have the same construction. Each loop 24 has ring 26, and a cylindrical wall 32 that resembles a cylinder that extends vertically from the ring 26 to form a tube-like extension. Each wall 32 defines a channel 30 that allows air to enter each channel 30 (e.g., in the direction of the arrow 36) from the bottom edge 34 of the corresponding wall 32. Each channel 30 functions to direct a collected mass of air towards the top edge 38 of the corresponding wall 32, so as to further facilitate the generation of a full and complete bubble by the loop 24.

Each ring 26 and its cylindrical wall 32 is serrated such that ridges or bumps 28 are provided on the outer circumferential surface 42 and inner circumferential surface 40 of the wall 32. The ridges 28 function to hold the bubble solution against the wall 32 to form a solution film that is blown to form the bubble. The cylindrical wall 32 can have any desired shape, such as circular (as shown), oval, square, rectangular, etc.

The quality of the bubble produced by the loops 24 can be enhanced by adding a flared semi-circular bottom edge 48 that extends from the bottom edge 34 of each cylindrical wall 32. Each flared edge 48 flares or extends radially away from the wall 32 at an angle (as best shown in FIGS. 2 and 3) with respect to the axis defined by direction of air flow as indicated by the arrow 36 (i.e., with respect to the orientation of the cylindrical wall 32). Ridges 28 can extend along the inner and outer surfaces of the flared edge 48. The flared edge 48 is effective in trapping bubble solution and allows easier flow of the bubble solution to the surfaces 40, 42 of the wall 32. The flared nature of the flared edge 48 also functions to funnel more air into the channel 30, thereby improving air flow. Tests have shown that the provision of the flared edges 48 to each cylindrical wall 32 has resulted in an increase in the number of bubbles being produced by the loops 24. As shown in FIGS. 2 and 3, the flared edge 48 extends across a portion (e.g., a semi-circular portion) of the bottom edge 34.

To further enhance the quality of the bubble produced by the loops 24, each wall 32 can be angled. In other words, each wall 32 can be configured so that it has a varying length (as measured from the top edge 38 of the loop 24) around its circumference. For example, referring to FIG. 3, the flared edge 48 provides an angled configuration (i.e., with respect to the horizontal axis defined by the ring 26) to the bottom edge 34 of each cylindrical wall 32. The angled configuration of the walls 32 shown in FIG. 3 efficiently captures any air that is directed through the channel 30. Each angled cylindrical wall 32 traps the air and concentrates the trapped air mass to direct them through the channel 30. This increases the amount of air that actually passes through the corresponding channel 30, and minimizes air that passes around the wall 32. As a result, better and more consistent streams of bubbles can be created by this construction.

In addition, the quality of the bubble produced by the loops 24 can be even further enhanced by increasing the length of the walls 32. This is because a longer cylindrical wall 32 has an increased inner volume (i.e., a greater volume in the channel 30) so that more air can be trapped and concentrated. However, if the length of the walls 32 is increased, greater air flow must be provided because the air that is trapped inside the respective channels 30 must travel a greater distance to exit the channel 30.

A central connector 44 is attached to a portion of the outer circumferential surface 42 of each cylindrical wall 32 at a location that is offset from the top edges 38 of the cylindrical walls 32, and preferably at a location that is somewhere between the top edges 38 and the bottom edges 34 of the cylindrical walls 32. FIG. 3 even illustrates the provision of the connector 44 adjacent to or very close to the bottom edges 34. The connector 44 is preferably positioned laterally (i.e., along the same axis) as the rings 26. Offsetting the connector 44 at a level that is different from the top edges 38 will minimize the production of attached bubbles from adjacent loops 24, since the bubble solution that extends across the top edge 38 of one loop 24 will not be directly adjacent to (or communicate with) the bubble solution that extends across the top edge 38 of an adjacent loop 24, having been separated by the offset location of the connector 44. In other words, the offset connector 44 reduces the distribution of the bubble solution at the top edges 38 of adjacent loops 24.

Two or more of the loops 24 are provided with a leg 50. The legs 50 are provided to mount or attach the bubble producing device 22 to a bubble gun 20 or other bubble assembly that might have incorporated therein an air generator (e.g., a motorized fan). As a non-limiting example, the legs 50 can attach the bubble producing device 22 to any of the bubble assemblies shown and described in U.S. Pat. No. 6,149,486 to Thai, whose disclosure is incorporated as though set forth fully herein. Each leg 50 extends from a portion of the corresponding wall 32. These legs 50 can be spaced-apart in an equidistant manner from each other, or provided at any desired spacing. In addition, any number (i.e., two or more) of the legs 50 can be chosen by the designer.

Any number of loops 24 can be provided. For example, FIG. 1 illustrates the provision of four loops 24, while FIG. 2 illustrates the provision of five loops 24.

Thus, the present invention provides a bubble producing device 22 that produces a larger number of bubbles, while producing bubbles of improved quality that do not stick to each other.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble producing device, comprising at least one loop, the loop having:

a cylindrical wall having an interior channel, a top edge and a bottom edge; and a flared edge extending at an angle with respect to the cylindrical wall from a portion of the bottom edge;

wherein the cylindrical wall has an inner surface and an outer surface, and wherein the loop further includes a plurality of ridges provided along the inner and outer surfaces of the cylindrical wall.

2. The device of claim 1, wherein the bottom edge of the cylindrical wall is angled.

3. A bubble producing device, comprising:

a plurality of loops, each of said loops having a cylindrical wall having an interior channel, a top edge and a bottom edge; and a connector attached to the cylindrical wall of each of said loops at a location that is offset from the top edge of each of said loops;

wherein the cylindrical wall of each of said loops has an inner surface and an outer surface, and wherein at least one of said loops further includes a plurality of ridges provided along the inner and outer surfaces of the cylindrical wall.

4. The device of claim 3, wherein the connector attached to the cylindrical wall of each of said loops at a location that is between the top edge and the bottom edge of each of said loops.

5. The device of claim 3, wherein at least one of said loops further includes a flared edge extending at an angle with respect to the cylindrical wall of the at least one of said loops from a portion of the bottom edge of the at least one of said loops.

6. The device of claim 3, further including a plurality of legs, with each of said legs attached to a separate one of each of said loops.

7. The device of claim 3, wherein the bottom edge of at least one of the cylindrical walls is angled.

8. A bubble producing device, comprising:

a plurality of loops, each of said loops having:

a cylindrical wall having an interior channel, a top edge and a bottom edge; and a flared edge extending at an angle with respect to the cylindrical wall from a portion of the bottom edge; and a connector attached to the cylindrical wall of each of said loops at a location that is offset from the top edge of each of said loops;

wherein the cylindrical wall of each of said loops has an inner surface and an outer surface, and wherein at least one of said loops further includes a plurality of ridges provided along the inner and outer surfaces of the cylindrical wall.

9. The device of claim 8, wherein the bottom edge of at least one of the cylindrical walls is angled.

10. A bubble producing device, comprising:

(i) a plurality of loops, each of the plurality of loops having:

a cylindrical wall having an interior channel, a first bubble-forming edge defining a first opening and a second edge defining a second opening; and a connector attached to the cylindrical wall of each of the plurality of loops at a location that is offset from the bubble-forming edge of each of the plurality of loops; and (ii) means positioned adjacent the second edge for generating a stream of air via the second opening through the cylindrical wall and the first opening.

11. The device of claim 10, wherein the connector attached to the cylindrical wall of each of the plurality of loops at a location that is between the first bubble-forming edge and the second edge of each of the plurality of loops.

12. The device of claim 10, wherein the plurality of loops includes a first loop, the first loop further including a flared edge extending at an angle with respect to the cylindrical wall of the first loop from a portion of the second edge of the first loop.

* * * * *